US007832568B2

(12) United States Patent
Wu

(10) Patent No.: US 7,832,568 B2
(45) Date of Patent: Nov. 16, 2010

(54) CUP RACK

(76) Inventor: John-Ching Wu, 1F., No. 6, Alley 3, Lane 173, Sec. 3, Neihu Rd., Neihu Dist., Taipei City 114 (TW)

( * ) Notice: Subject to any disclaimer, the term of this patent is extended or adjusted under 35 U.S.C. 154(b) by 409 days.

(21) Appl. No.: 12/111,981

(22) Filed: Apr. 30, 2008

(65) Prior Publication Data

US 2009/0272704 A1 Nov. 5, 2009

(51) Int. Cl.
*A47G 29/00* (2006.01)

(52) U.S. Cl. ..... 211/85.29

(58) Field of Classification Search ..... 211/85.29, 211/94.02, 118, 126.15, 117, 18, 19, 113; 248/302, 298.1, 340
See application file for complete search history.

(56) References Cited

U.S. PATENT DOCUMENTS 4,738,369 A * 4/1988 Desjardins ..... 211/113
5,472,167 A * 12/1995 Shillington et al. ..... 248/552
6,357,607 B1 * 3/2002 Wu ..... 211/85.29
6,578,720 B1 * 6/2003 Wang ..... 211/126.15
6,843,381 B2 * 1/2005 Wu ..... 211/85.29
6,976,595 B1 * 12/2005 Geller ..... 211/94.01
7,014,052 B2 * 3/2006 Dettorre et al. ..... 211/85.7
7,131,545 B1 * 11/2006 Grogan ..... 211/85.29
7,604,131 B1 * 10/2009 Clark et al. ..... 211/17
7,617,649 B2 * 11/2009 Arakawa ..... 52/506.06
2003/0080077 A1 * 5/2003 Ruiz ..... 211/85.29
2004/0173548 A1 * 9/2004 Wu ..... 211/85.29
2007/0114195 A1 * 5/2007 Patsalaridis ..... 211/85.29

* cited by examiner

*Primary Examiner*—Jennifer E. Novosad
(74) *Attorney, Agent, or Firm*—Leong C. Lei

(57) ABSTRACT

The cup rack contains at least a lower rail suspended by at least two connection members. The connection members could be affixed to a bottom surface of a shelf or ceiling, or they could be slidably positioned in a pair of parallel upper rails. A number of hook members are hung across the lower rail. The positioning of the hook member is achieved by a bolt running through the hook member and into a block slidably positioned in the lower rail. Depending on how the block is oriented, the hook member could be locked to the lower rail or the hook member could be slid freely along the lower rail.

7 Claims, 5 Drawing Sheets

CUP RACK

(a) TECHNICAL FIELD OF THE INVENTION

The present invention generally relates to racks for holding cups or mugs, and more particularly to a cup rack where the number of accommodated cups and their positions could be dynamically and conveniently adjusted.

(b) DESCRIPTION OF THE PRIOR ART

A conventional cup or mug rack is shown in FIG. 1. The cup rack 1, as illustrated, contains a strip member 11 having a number of through holes 12 for affixing the strip member 11 to a bottom surface of a ceiling or shelf 2. A number of J-shaped hook members 13 are extended downward from a bottom side of the strip member 11 at equal spacing. Each hook member 13 therefore could hang a mug or cup 3 by its handle 31.

The hook members 13 are usually fixedly positioned. However, the cup or mug 3 could have various sizes. For large cup or mug 3, it would collide or even damage the neighboring cups or mugs 3. For small cup or mug 3, the extraneous gap to neighboring cups or mugs 3 is wasted.

SUMMARY OF THE INVENTION

The primary purpose of the present invention is to provide a novel cup rack where the number of accommodated cups or mugs and their positions could be dynamically and conveniently adjusted.

To achieve this objective, a cup rack according to the present invention contains at least a lower rail suspended by at least two connection members. The connection members could be affixed to a bottom surface of a shelf or ceiling, or they could be slidably positioned in a pair of parallel upper rails so that the lower rail could be slid freely along the upper rails.

A number of hook members are hung across the lower rail. The positioning of the hook member is achieved by a bolt running through the hook member and into a block slidably positioned in the lower rail. The block is configured such that, if it is positioned in the lower rail in one orientation, the bolt would lock the hook member to the lower rail and, if the block is positioned in a reversed orientation, the bolt would allow the block and thereby the hook member to be slid freely along the lower rail.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
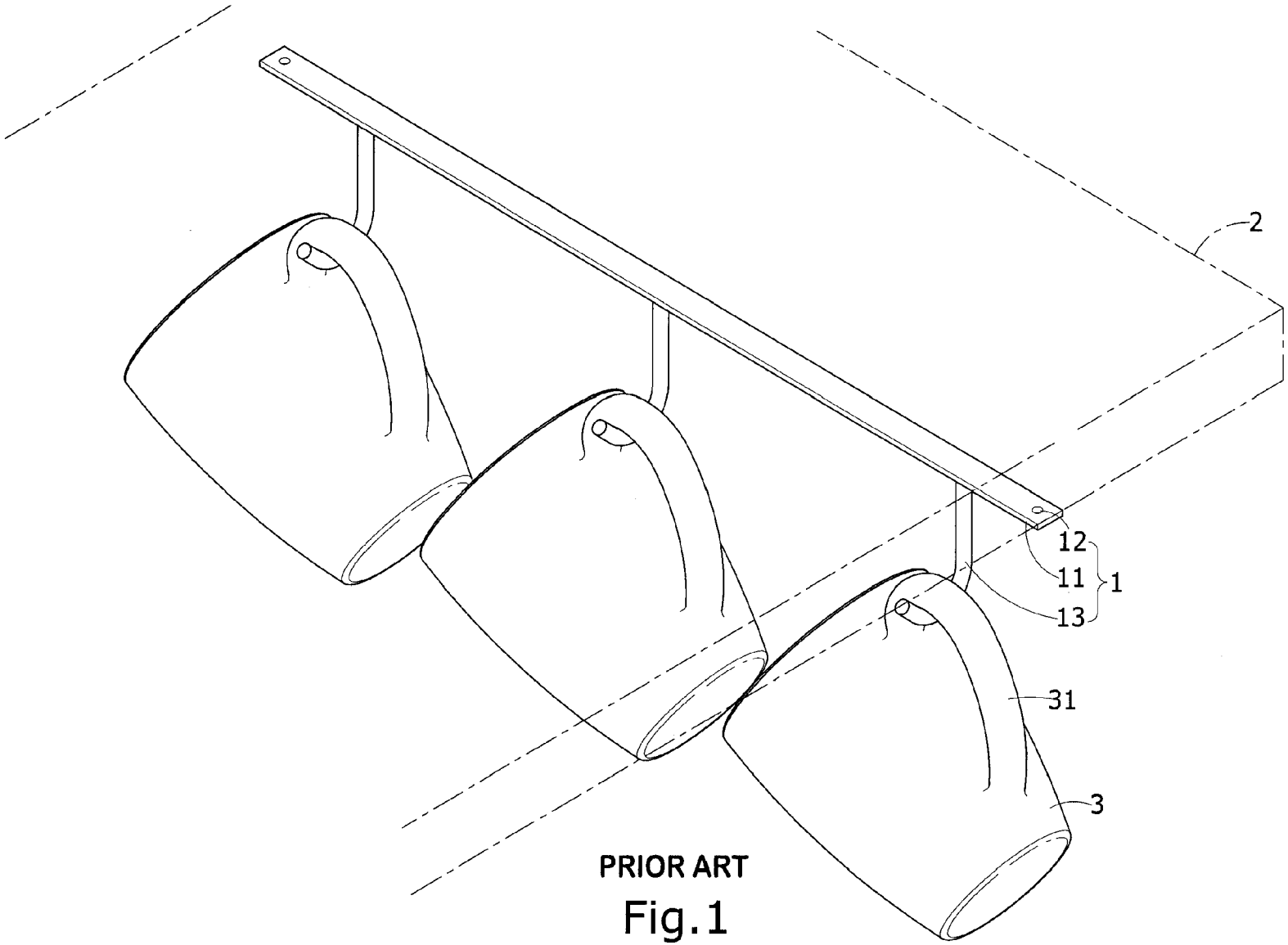
PRIOR ART Fig. 1
FIG. 1 is a perspective diagram showing a conventional cup rack.
Figure 2:
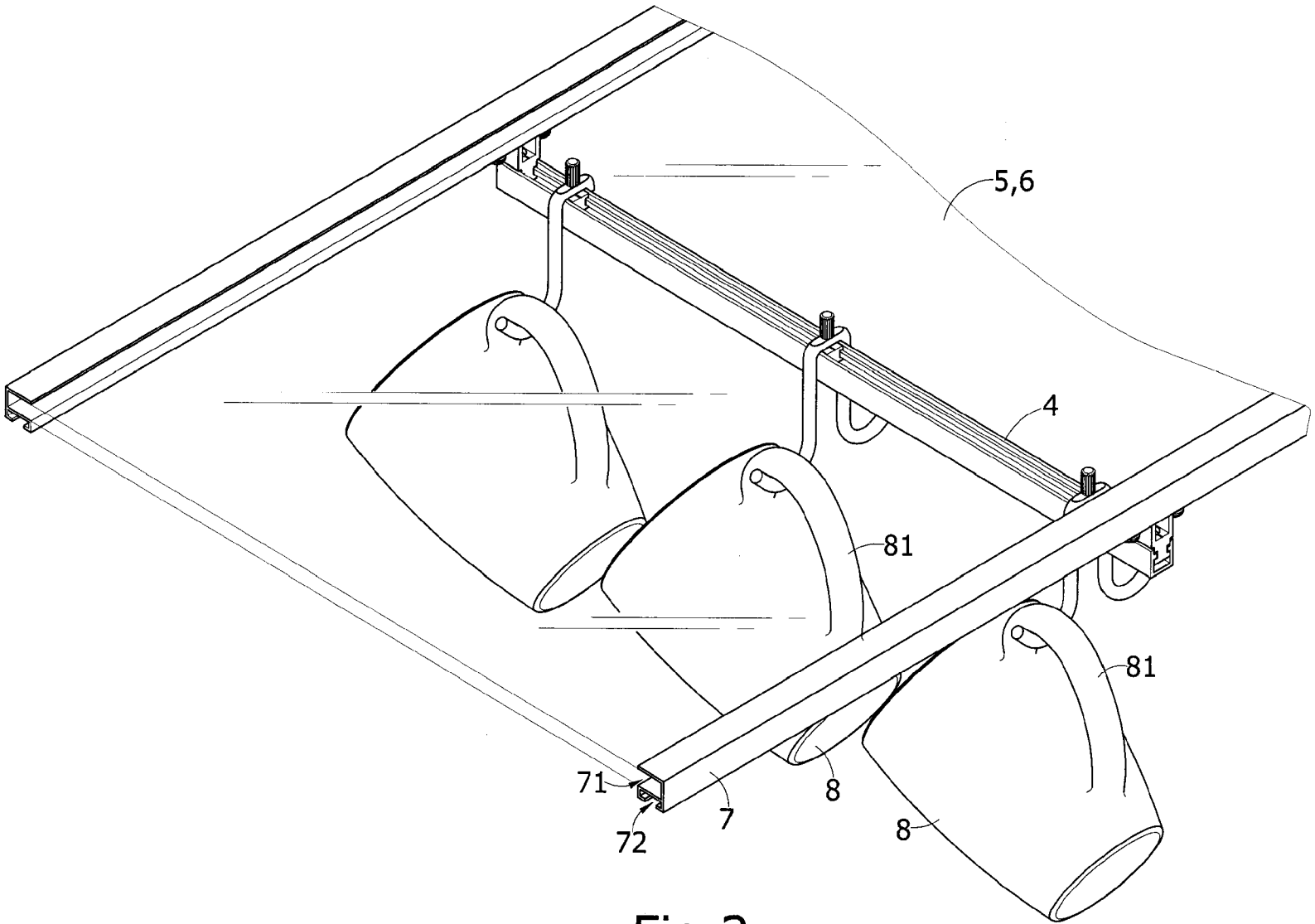
FIG. 2 is a perspective diagram showing a cup rack according to an embodiment of the present invention.
Figure 3:
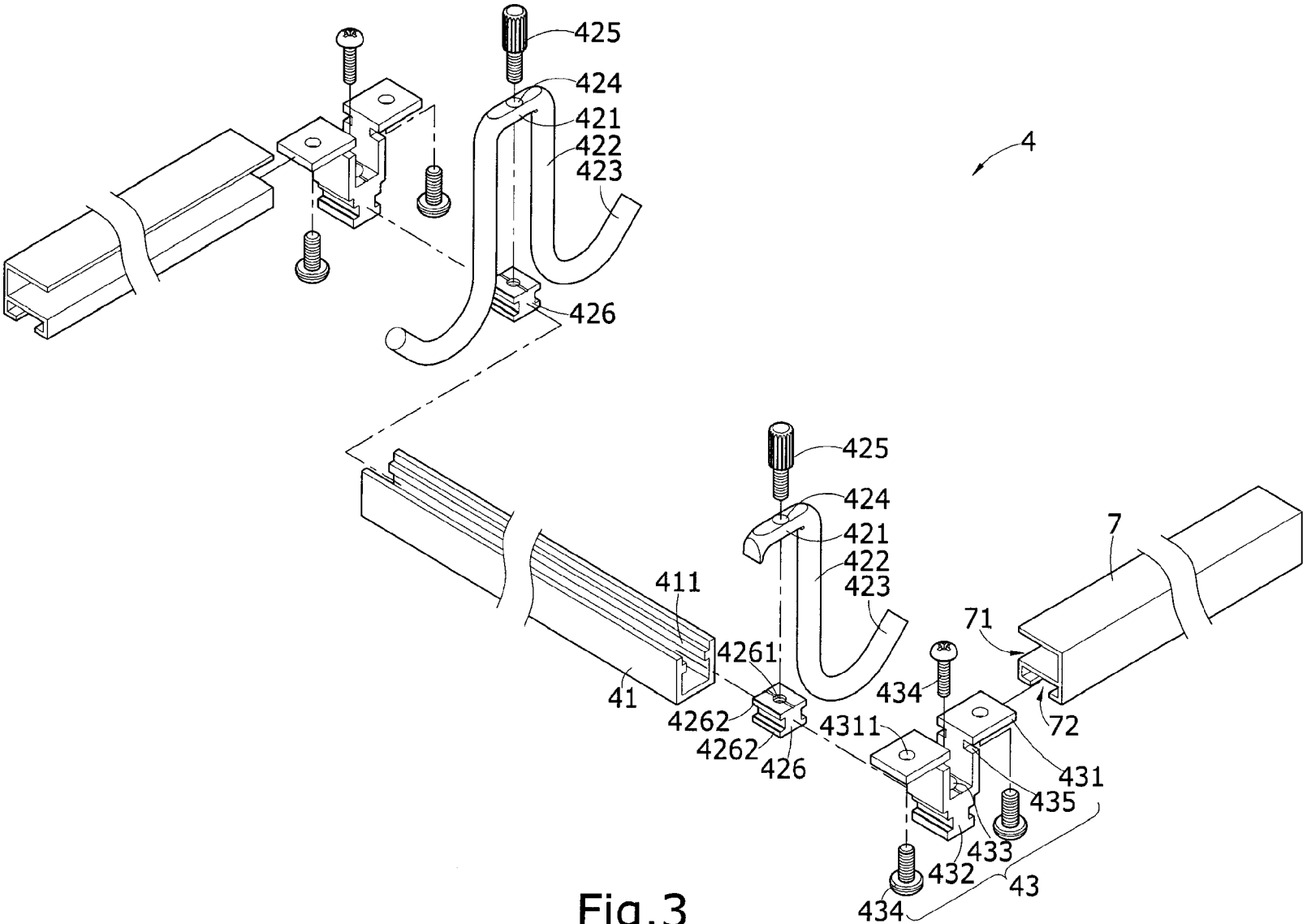
FIG. 3 is a perspective exploded diagram showing the various components of the cup rack of FIG. 2.

As shown in FIG. 2, a cup rack 4 according to an embodiment of the present invention is positioned on a bottom surface of a shelf 5 or a ceiling 6. As illustrated, preferably, the cup rack 4 has a pair of upper rails 7 removably mounted to two opposing edges of the shelf 5 or ceiling 6, respectively. The shelf 5 or ceiling 6 could be made of any appropriate material. In FIG. 2, the shelf 5 or ceiling 6 is made of glass. Each upper rail 7 has a U-shaped-cross-sectional end-to-end upper trough 71 open to a lateral side for accommodating an edge of the shelf 5 or ceiling 6, and a T-shaped-cross-sectional end-to-end lower trough 72 beneath the upper trough 71 open to a bottom side for the sliding movement of a lower rail 41.

The lower rail 41 has a U-shaped cross section with two opposing end-to-end ribs 411 along two opposing inner surfaces. The ribs 411 are at an appropriate distance from a top opening of the lower rail 41.

A number of hook members 42 are hung across the lower rail 41. Each hook member 41 has a lateral section 421 positioned right above the lower rail 41. A vertical section 422 is extended downward from at least an end of the lateral section 421. In turn, a hook section 423 is extended upward from a bottom end of the vertical section 422 so as to hang a handle 81 of a cup 8.

A block 426 is affixed to a bottom side of the lateral section 421 of the hook member 42 by running a bolt 425 through a through hole 424 of the lateral section 421 from above and then into a bolt hole 4261 on a top side of the block 426. The block 426 has an I-shaped cross section with two upper wings 4262 extended laterally and oppositely from a top end and two lower wings 4262 extended laterally and oppositely from a bottom end of the block 426. The upper and lower wings 4262 are of different thickness. However, the block 426 could be positioned inside the lower rail 41 with the upper wings 4262 or the lower wing 4262 above the ribs 411. In either way, the block 426 is reliably positioned in the lower rail 41 by the rib 411.

The lower rail 41 is joined at least to two Y-shaped connection members 43, respectively. Each connection member 43 has two L-shaped arms, each of which contains a lateral section 431 and a vertical section. The lateral sections 431 of the two arms are laterally and oppositely extended from the vertical sections' top ends, respectively. The vertical sections have their bottom ends connected to a body 432 shaped similarly to the block 426 so that the connection member 43 could have its body 432 positioned inside and slid along the lower rail 41. The body 432 has a vertical through channel 433 so that a bolt 434 could be driven through to fix the connection member 43 at an appropriate location along the lower rail 41. Each lateral section 431 has a through hole 4311 so that a bolt 434 could be driven through to fix the connection member 43 to a bottom surface of a shelf 5 or ceiling 6. Alternatively, as illustrated, each vertical section could have two opposing lateral slots 435 adjacent to the lateral section 431. As such, the lateral sections of the connection member 43 could be slid into the lower trough 72 of an upper rail 7. In this way, the position of the lower rail 41 along the upper rails 7 could be easily adjusted.

As described above, the cup rack 4 could be easily assembled and disassembled. In addition, additional or extraneous hook members 42 could be added or removed dynamically and conveniently. Most importantly, each hook member 42 could be slid easily along a lower rail 41, or it could be fixed at a specific location.

Figure 5:
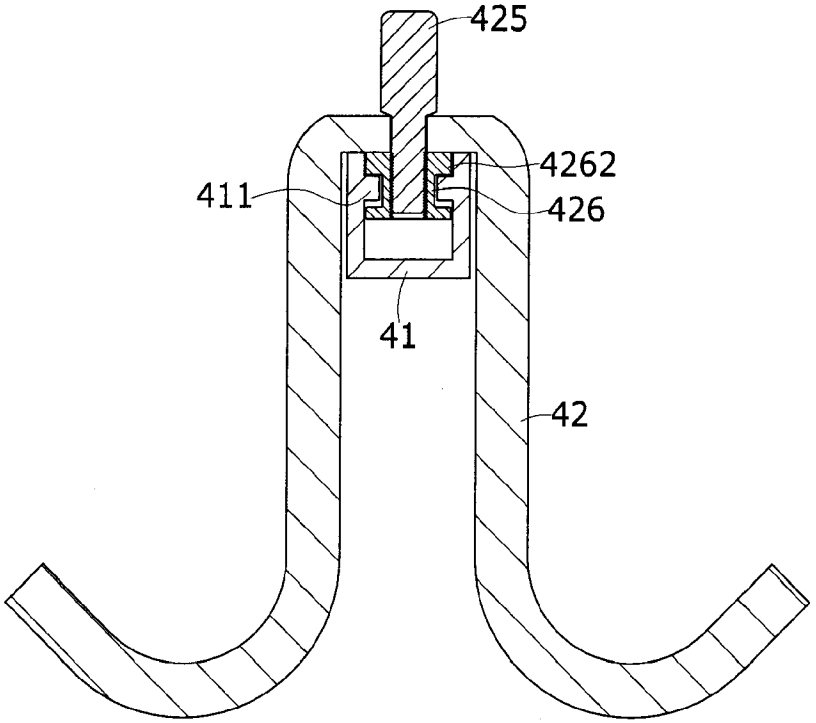
FIG. 5 is schematic diagram showing a hook member of the cup rack of FIG. 2 in a locked configuration.
Figure 4:
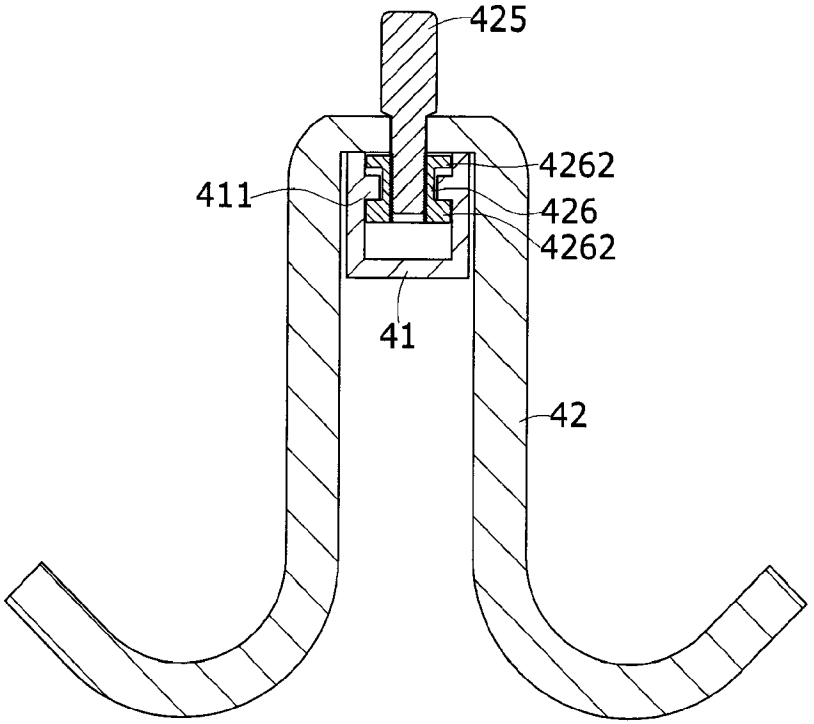
FIG. 4 is schematic diagram showing a hook member of the cup rack of FIG. 2 in a slidable configuration.

As mentioned earlier that the upper and lower wings 4262 of each block 426 are of different thicknesses. As shown in FIG. 4, if the block 426 are oriented such that the thinner wings 4262 are above the ribs 411 and as the bolt 425 is driven through the hook member 42 and into the block 426, the block 426 is pulled upward so as to lock the hook member 42 to the lower rail 41. As such, the hook member 42 is fixed at its position and cannot be slid along the lower rail 41. On the other hand, as shown in FIG. 5, when the block 426 are oriented such that the thicker wings 4262 are above the ribs 411 and as the bolt 425 is driven through the hook member 42 and into the block 426, the bolt 425 is not able to pull the block 426 upward and the hook member 42 therefore could be slid along the lower rail 41 freely.

Figure 6:
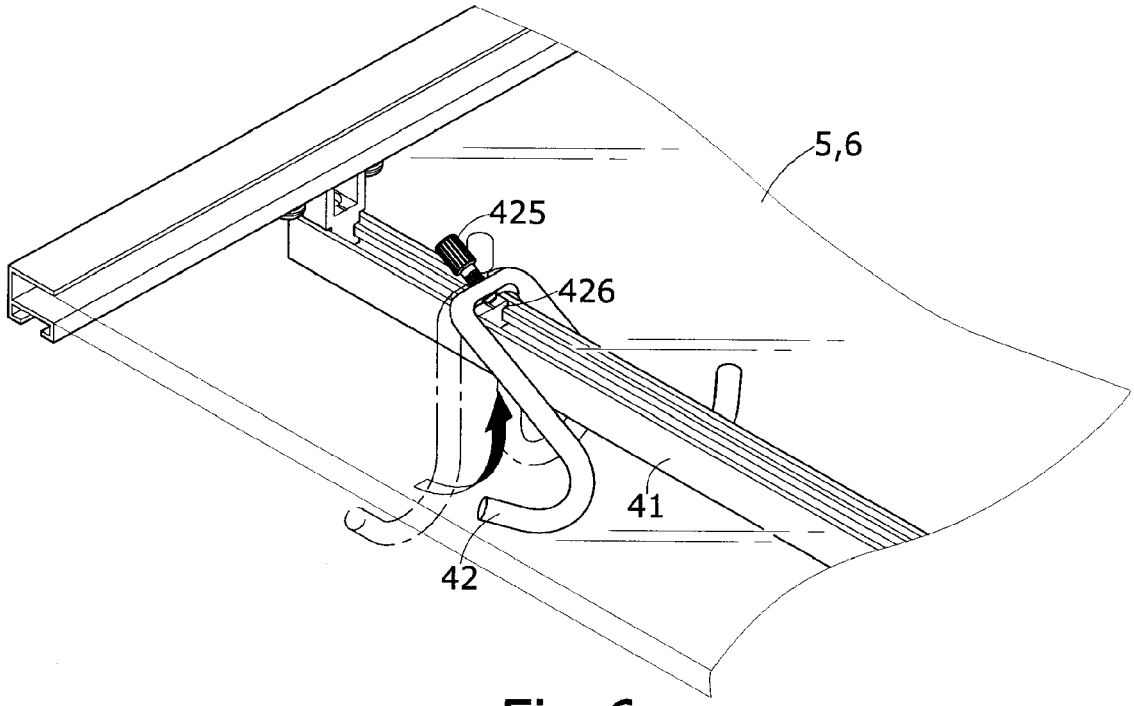
FIGS. 6 and 7 show a scenario of removing a hook member from the cup rack of FIG. 2.
Figure 7:
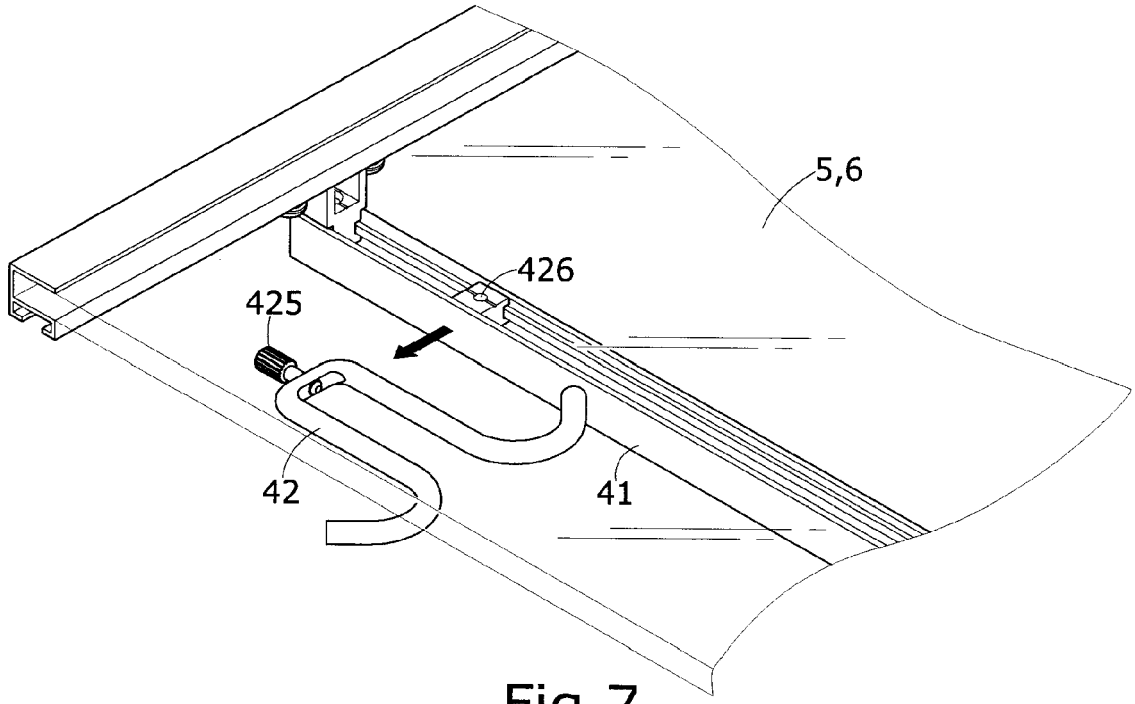

As shown in FIGS. 6 and 7, after the upper rails 7 and lower rail 41 are assembled beneath a shelf 5 or ceiling 6, a hook member 42 could be dynamically removed or added. As illustrated, to remove an already installed hook member 42, the bolt 425 is first unscrewed so that it is separated from the block 426 (but still joined to the hook member 42). The hook member 42 is then tilted to a side until it is parallel to the lower rail 41. The hook member 42 then could be removed from the gap between the lower rail 41 and the shelf 5 or ceiling 6. To reinstall the hook member 42 or add an addition hook member 42, a user just needs to follow the foregoing procedure in reversed order.

As described above, the cup rack 4 according to the present invention could have two or more lower rails 41 suspended between a pair of upper rails 7 and their positions could be freely adjusted by sliding them to appropriate locations along the upper rails 7. Each lower rail 41 could have multiple hook members 42 installed and they could be either locked to the lower rail 41 or they could be slid freely along the lower rail 41.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cup rack, comprising:

a lower rail having a U-shaped cross section with two opposing end-to-end ribs along two opposing inner surfaces;

a plurality of hook members hung across said lower rail, each hook member having a lateral section positioned above said lower rail, a vertical section extended downward from at least an end of said lateral section, a hook section extended from a bottom end of said vertical section for hanging a cup by its handle, and a block beneath said lateral section of said hook member and slidably positioned in said lower rail; and at least two Y-shaped connection members, each connection member having two L-shaped arms, each of which contains a lateral section and a vertical section, said lateral sections of said arms laterally and oppositely extended from top ends of said vertical sections of said arms, respectively, said vertical section of said arms having their bottom ends connected to a body slidably positioned in said lower rail.

2. The cup rack according to claim 1, wherein a bolt is run through a through hole of said lateral section of said hook member and into a hole on a top side of said block.

3. The cup rack according to claim 1, wherein said block has two upper wings extended laterally and oppositely from a top end and two lower wings extended laterally and oppositely from a bottom end of said block; and said upper and lower wings are of different thickness.

4. The cup rack according to claim 1, wherein said body of each connection member has a vertical through channel so that a bolt is driven through to fix said connection member at an appropriate location along said lower rail.

5. The cup rack according to claim 1, wherein each lateral section of each connection member has a through hole so that a bolt is driven through to fix said connection member to a bottom surface of a shelf or ceiling.

6. The cup rack according to claim 1, further comprising a pair of upper rails removably mounted to two opposing edges of a shelf or ceiling, each upper rail having a U-shaped-cross-sectional end-to-end upper trough open to a lateral side for accommodating an edge of said shelf or ceiling, and a T-shaped-cross-sectional end-to-end lower trough beneath said upper trough open to a bottom side.

7. The cup rack according to claim 6, wherein each vertical section of each connection member has two opposing lateral slots so that said lateral sections of said connection member are slidably positioned in said lower trough of an upper rail.

* * * * *